US010056663B2

(12) United States Patent
Wiehler et al.

(10) Patent No.: US 10,056,663 B2
(45) Date of Patent: Aug. 21, 2018

(54) INTERMODULATION DISTORTION REDUCTION SYSTEM USING INSULATED TUNING ELEMENTS

(71) Applicant: COMMUNICATION COMPONENTS, INC., Seabrook, NH (US)

(72) Inventors: Eric Wiehler, Sandown, NH (US); Gerald Towne, Salem, NH (US)

(73) Assignee: COMMUNICATIONS COMPONENTS, INC., Seabrook, NH (US)

( * ) Notice: Subject to any disclaimer, the term of this patent is extended or adjusted under 35 U.S.C. 154(b) by 55 days.

(21) Appl. No.: 14/875,172

(22) Filed: Oct. 5, 2015

(65) Prior Publication Data

US 2016/0190669 A1 Jun. 30, 2016

Related U.S. Application Data

(62) Division of application No. 13/675,327, filed on Nov. 13, 2012, now abandoned.

(51) Int. Cl.

| | |
|---|---|
| ***H01P 1/202*** | (2006.01) |
| ***H01P 7/04*** | (2006.01) |
| ***H01P 1/207*** | (2006.01) |
| ***H01P 1/208*** | (2006.01) |
| ***H01P 7/06*** | (2006.01) |
| ***H01P 1/205*** | (2006.01) |

(52) U.S. Cl.

CPC ..... *H01P 1/202* (2013.01); *H01P 1/205* (2013.01); *H01P 1/207* (2013.01); *H01P 1/208* (2013.01); *H01P 7/04* (2013.01); *H01P 7/06* (2013.01)

(58) Field of Classification Search

CPC .. H01P 1/202; H01P 7/04; H01P 1/208; H01P 1/205; H01P 7/06

USPC ..... 333/207, 222–224, 227, 231

See application file for complete search history.

(56) References Cited

U.S. PATENT DOCUMENTS

| | | | |
|---|---|---|---|
| 6,320,484 | B1 | 11/2001 | Furuya et al. |
| 6,384,699 | B1 | 5/2002 | Henningsson et al. |
| 2010/0073111 | A1 | 3/2010 | Archer et al. |

*Primary Examiner* — Rakesh Patel

(74) *Attorney, Agent, or Firm* — Sofer & Haroun, LLP

(57) ABSTRACT

A coaxial cavity resonator filter has a hollow cavity and a post having desired dimensions for achieving desired filter characteristics. A tuning element is supported within a metallic opening and is configured to electromagnetically interact with the post. The tuning element has a conductive core element where the orientation of the tuning element with the cavity is adjusted so as to achieve the desired filter characteristic. An insulator is configured to cover a portion of the conductive core element of the tuning element, at a location where the tuning element and the metallic opening interact. A portion of the insulator is threaded so as to allow the conductive core element vary its orientation within the cavity without contacting the metallic opening.

11 Claims, 8 Drawing Sheets

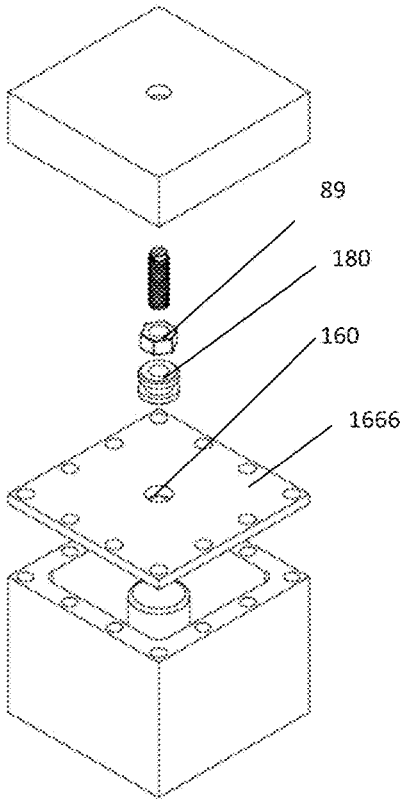
Fig.10a
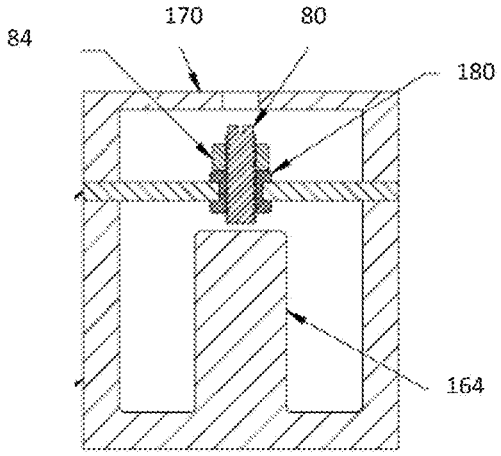
Fig.10b SECTION A-A

INTERMODULATION DISTORTION REDUCTION SYSTEM USING INSULATED TUNING ELEMENTS

RELATED APPLICATION

This application is a divisional application of U.S. patent application Ser. No. 13/675,327, filed on Nov. 13, 2012, the entirety of which is incorporated by reference.

BACKGROUND

Field of the Invention

This invention relates to Radio Frequency Communication transceivers and in particular to RF filters with reduced intermodulation distortion characteristics.

Description of Related Art

A typical wireless communication system, such as cellular transceiver, includes uplink and downlink channels separated in frequency. Such communication systems use filters to route, combine, and/or separate signals at different frequencies, to prevent interfering with other channels or systems, and/or to prevent being interfered with by other channels or systems.

One type of filter used in such communication systems is constructed with coaxial cavity resonators, sometimes referred to as combline or interdigital resonators. These resonators typically consist of a metal outer conductor or cavity with a metal inner conductor. The inner conductor is electrically short circuited to the outer conductor at one end and open circuited at the other end. When an electromagnetic wave is coupled to this structure, the wave propagates along its length until it encounters the short circuit and is reflected back. This reflection causes a standing wave to be generated when the length of the inner conductor is approximately ¼ wave length long relative to the frequency of the coupled wave. Shorter lengths can also be used by capacitively loading the open circuit end. This standing wave can then be further coupled to adjacent resonators, allowing waves at specific frequencies to propagate while rejecting waves at other frequencies.

However, coaxial cavity resonators can cause signal corruption. Signal corruption can occur when intermodulation Distortion (IMD) generated by the uplink or downlink signals fall unintentionally into the downlink or uplink frequency band, respectively. IMD in filters can create the very interference they are supposed to be preventing.

As such there is a need to enhance the performance of such coaxial cavity resonators employed in wireless base stations and to specifically reduce or preferably eliminate intermodulation distortion.

OBJECT AND SUMMARY OF THE INVENTION

As more spectrum is being allocated for wireless communications, the problem of intermodulation distortion has become more noticeable. A common construction of filters for wireless communication systems is machined metal housings using metal posts as combline or interdigital resonators. Current cost effective machining techniques are not accurate enough to produce these structures repeatedly so tuning elements are often employed to compensate for these inaccuracies. These tuning elements are often shaped as a threaded metal rod, with an arrangement for varying its length to achieve the desired filtering effect. Consequently, the contact area where the threads meet the housing is weak and/or intermittent. Current flows in these areas causing potential intermodulation distortion.

Intermodulation distortion is generated when two or more signals encounter non-linear elements during transmission. One source of non-linearity is weak and/or intermittent metal to metal contact in areas where current flows. As such, the tuning elements intended to fine tune the resonator filter can cause the very distortion that they intended to overcome. In accordance with one embodiment of the invention a coaxial cavity resonator filter is provided having a cylindrical hollow post. The post is configured to receive a frequency tuning element. The post includes a first opening and an inner wall, such as a cylindrical wall having a diameter that is larger than the diameter of the tuning element. The post further includes a flange that forms a second opening having a specified height and a diameter that is smaller than the diameter of the inner wall of the first opening.

An insulating support member is disposed within the post. The insulating support member is made of an insulating material such as Teflon® or a polyetherimide such as Ultem®, and it has a first head portion having a first diameter and a shoulder flange portion having a smaller diameter with a threaded internal wall. The shoulder flange portion of the insulating support is fitted within the second opening of the post. The insulating support is configured to receive a tuning element that can be screwed via its internal threaded portion. In an alternative embodiment, the tuning element includes an insulated threaded sleeve positioned at a desired portion along its length, and the second opening of the post is similarly threaded. As such, during operation the insulated threaded portion of the tuning element engages the threaded second opening and the length of the tuning element is adjusted to achieve a desired frequency response.

In accordance with yet another embodiment the insulated sleeve is moveable along the length of the tuning element to provide an optimum location for the tuning element along the hollow tube of the post.

In accordance with yet another embodiment the insulated sleeve is mounted in the cavity cover such that the tuning element is external to the resonator post. The length of the tuning element is adjusted to achieve the desired frequency response from the coaxial cavity resonator. In this configuration, the tuning element can also be used to adjust the coupling between adjacent resonators.

BRIEF DESCRIPTION OF THE DRAWINGS

In accordance with various embodiments of the invention the following description and accompanying drawings describe the various features of the invention as claimed, wherein:

FIGS. 10*a*-10*b* illustrate another filter having a solid post in accordance with an embodiment of the invention;

DETAILED DESCRIPTION

The coaxial cavity resonator filters discussed in relation to various embodiments of the invention are typically employed in wireless base stations, such as cellular communication base stations. A desired characteristic of such filters is to have low insertion losses in the passband frequency range of the transmitted or received signals, along with high attenuation in the stopband frequency range close to the passband frequency range.

Figure 1:
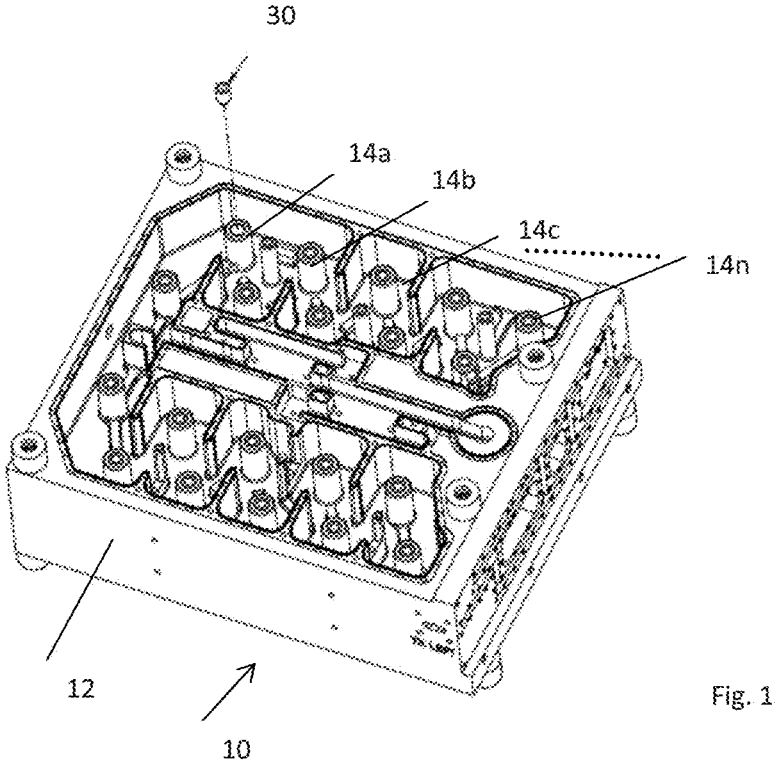
FIG. 1 illustrates a coaxial cavity resonator filter according to one embodiment.

FIG. 1 illustrates a coaxial cavity resonator filter structure of a transmitter/receiver filter 10, in a housing 12. Filter 10 includes a top plate (not shown), which is removed from the top portion of transmitter/receiver filter as illustrated in FIG. 1. A plurality of coaxial cavity resonators 14(*a*), 14(*b*), 14(*c*) . . . 14(*n*) are arranged to form desired filters. Such resonators in accordance with various embodiments of the invention are serially or sequentially coupled to obtain the desired filter characteristics. In one embodiment of the invention one set of filters 14 may be coupled to form the transmit filter of a base station. This filter receives the energy from the transmit section of the base station, and filters the energy according to a designated transmit-frequency passband. Another set of filters 14 corresponds to the receive filter of the base station. This filter receives energy from the radio antenna of the base station and filters the energy according to a designated receive-frequency passband.

Figure 2B:
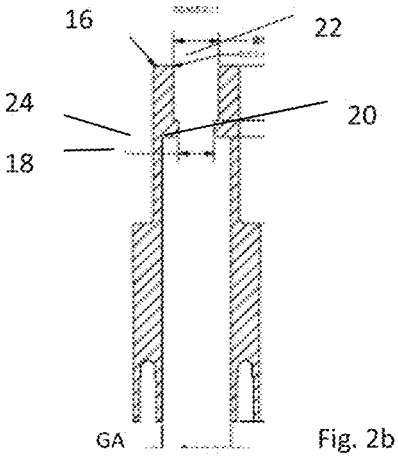
FIGS. 2*a* and 2*b* illustrate a coaxial cavity resonator employed in the coaxial cavity resonator filter of FIG. 1.
Figure 2A:
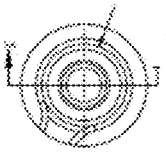

FIGS. 2*a* and 2*b* illustrate a coaxial cavity resonator 14 in accordance with one embodiment of the invention. FIG. 2*b* is a section view of the resonator and FIG. 2*a* is its top view. Coaxial cavity resonator 14 includes a hollow upper portion 16 and a hollow lower portion 18, separated by an aperture 20. The internal diameter of aperture 20 is smaller than the internal diameters of upper portion 16, forming a flange 24. The top portion includes an opening 22 with an internal diameter that is larger than the diameter of aperture 20. In accordance with one embodiment of the invention, opening 22 has the same diameter as the internal diameter of upper portion 16. In accordance with one embodiment of the present invention, the internal diameter of aperture 20 is about 8 millimeters with a tolerance of about +0.01 mm and −0.02 mm. The internal diameter of aperture 20 is about 6.25 mm, and the length of upper portion is about 10 mm. The internal diameter of lower portion 18 is about 12 mm and the length of lower portion 18 is about 51.77 mm.

Figure 3A:
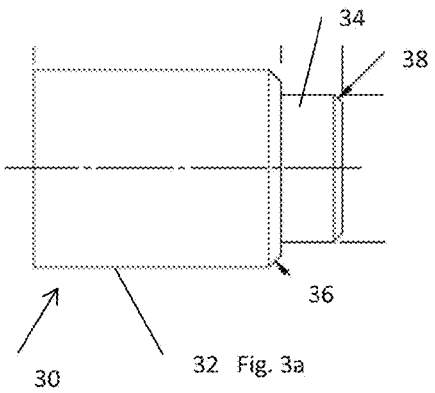
FIGS. 3*a* and 3*b* illustrate an insulating support member according to one embodiment.

FIG. 3*a* illustrates an insulating support member 30 in accordance with one embodiment of the invention. Insulating support member 30 is made of an insulating material such as Ultem® or Teflon®, and is configured to fit within coaxial cavity resonator 14 illustrated in FIGS. 2*a* and 2*b*. Insulating support member 30 includes a head portion 32 and a shoulder portion 34. Head portion 32 has an outside diameter that is larger than the outside diameter of shoulder portion 34. In accordance with one embodiment of the invention, the outside diameter of head portion 32 tapers towards the shoulder portion along taper 36. Similarly, shoulder portion 34 tapers in via taper 38.

Furthermore, the inside diameter of shoulder portion 34 is threaded so as to accommodate the turning of a tuning element configured to pass through insulating support 30 as will be explained in more detail below. In accordance with one embodiment of the invention, the diameter of head portion 32 is about 8 mm. For this embodiment, the length of the shoulder portion is about 10 mm and the length of the head portion is about 2.5 mm providing an overall length of 12.5 mm for the insulated support member.

Figure 3B:
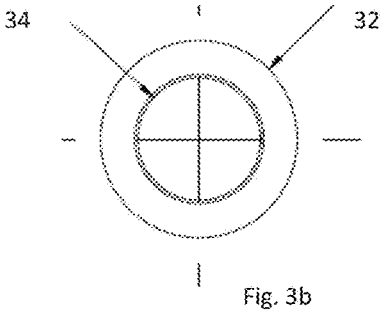

The insulated support member is configured to fit within the coaxial cavity resonator, such as 14 illustrated in FIG. 2, such that the shoulder portion is fitted within aperture 20 and head portion 32 is disposed within the upper portion of the coaxial cavity resonator. Turning to FIGS. 3*a* and 3*b*, insulating support member is illustrated, prior to placing it within coaxial cavity resonator 14*a*.

Figure 4:
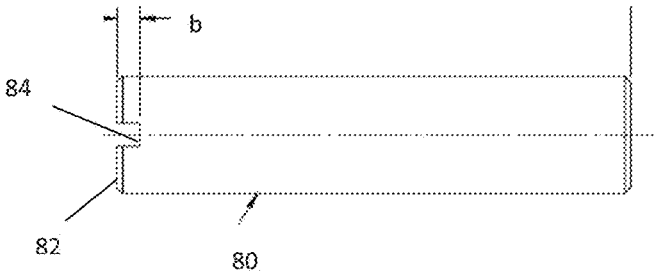
FIG. 4 illustrates a tuning element according to one embodiment.

Once insulated support 30 is placed within the coaxial cavity resonator as described above, a tuning element 80 illustrated in FIG. 4 can be threaded within the support member to adjust its length within the coaxial cavity resonator to achieve the desired frequency characteristics. To this end, FIG. 4 illustrates tuning element 80 that has a specified length and diameter depending on the size of the coaxial cavity resonator is screwed into insulated support 30. The outside diameter of tuning element 80 is threaded so that it engages the threaded inner diameter of insulating support 30. Tuning element 80 has a head portion 82, with a slot 84 for driving the element in and out of the insulating support and the coaxial cavity resonator. The pitch of the threads of tuning element 80 is designed to provide accurate control of the length of the tuning element within the coaxial cavity resonator.

Figure 5:
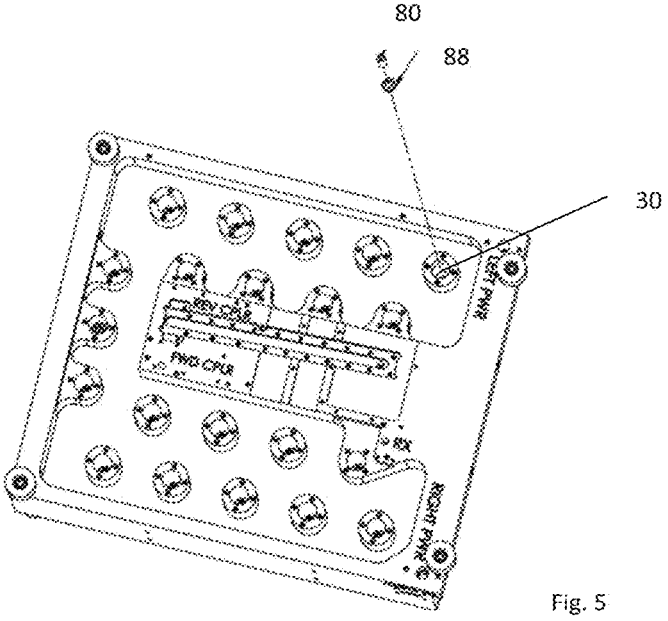
FIG. 5 illustrates a tuning element and a locking nut within an insulating support member according to one embodiment of the invention.

FIG. 5 illustrates the bottom side of filter 10 referred in FIG. 1 above. One of the coaxial cavity resonators shown in FIG. 1, such as 14(*d*) is fitted with an insulating support 30. Thereafter, a tuning element 80 is inserted within the insulating support and threaded within the coaxial cavity resonator until the desired frequency response is achieved. A locking member, such as lock nut 89 assures that the tuning element remains at a specific length during the operation of filter 10. In accordance with one embodiment of the invention, lock nut 89 is made of Ultem® or Teflon®. Once the proper length of tuning element 80 has been determined, a locking ember 89 is screwed on the tuning element to fix the effective length of the tuning element during the operation of the filter.

Figure 6:
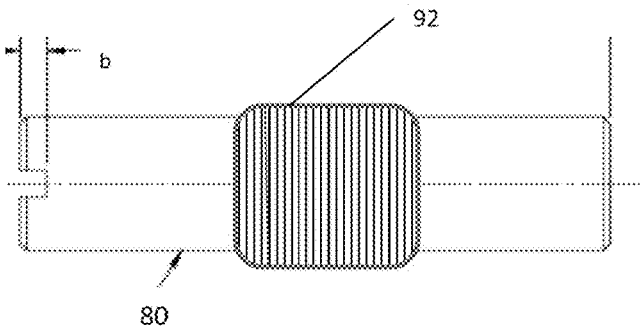
FIG. 6 illustrates another tuning element according to another embodiment.

In accordance with another embodiment of the invention, instead of using insulating support 30, tuning element 80 is fitted with a threaded insulating sleeve. As such FIG. 6 illustrates tuning element 80 having an insulating sleeve 92 that is threaded so as to allow the tuning of element 80 once it is within the coaxial cavity resonator. In accordance with this embodiment of the invention, tuning element 80 is inserted within the coaxial cavity resonator post, such that the sleeve portion of tuning element 80 engages the inner diameter of aperture 20 of the coaxial cavity resonator which is threaded.

Figure 7:
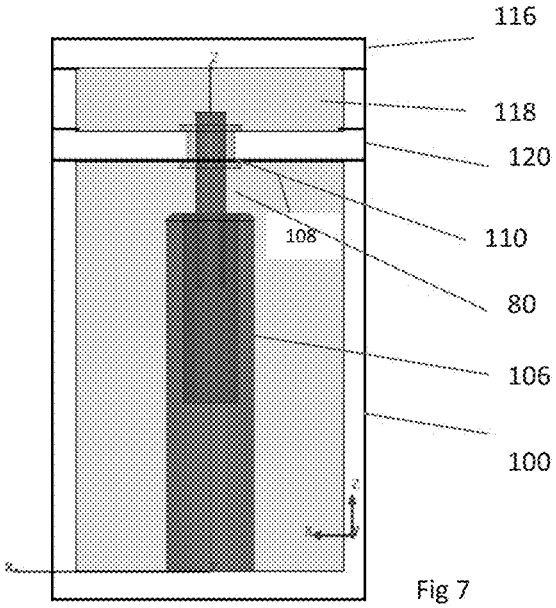
FIG. 7 illustrates a coaxial cavity resonator structure according to one embodiment.

FIG. 7 illustrates a configuration where the tuning element 80 is external to a resonator post 106 and insulated from a cavity cover 120 by insulating support 110. Resonator post 106 is enclosed in cavity 100. A second cover 116 is employed to create an isolation cavity 118 such that any existing adjacent resonators do not couple through the portion of the tuning element that protrudes above cavity cover 120. The same combinations of threaded support and tuning element described above are relevant here. The tuning element is moved in and out to achieve the desired frequency response.

Figure 8:
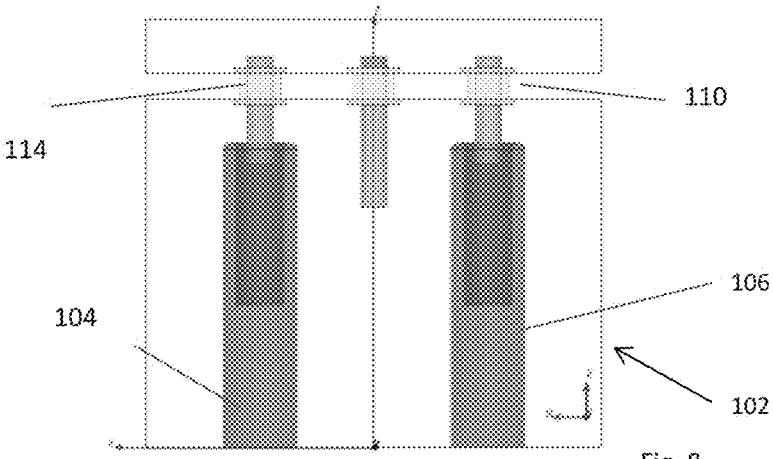
FIG. 8 illustrates a coaxial cavity resonator structure according to one embodiment.

It is appreciated by those skilled in the art that, depending on frequency characteristics requirements, sometimes a single coaxial cavity resonator is employed and other times two or more coaxial cavity resonators are coupled together by employing an arrangement where a coupling tuning element is used to achieve the desired filter characteristics. In accordance with one embodiment of the present invention, FIG. 8 illustrates a structure 102 having adjacent coaxial cavity resonators 104 and 106. Resonators 104 and 106 are coupled through the magnetic field around the resonators. As described earlier, when an electromagnetic wave of the appropriate frequency is coupled to a resonator, a standing wave is generated. This standing wave has a magnetic field associated with it. The electromagnetic wave is sinusoidal so the resulting magnetic field is also sinusoidal. When this magnetic field is incident on the second resonator the electromagnetic wave will couple to the second resonator which in turn will generate a standing wave. This process can be repeated for any desired number of N resonators. The coupling tuning element between the resonators allows the magnetic field of the first resonator to couple to the element which in turn couples to the second resonator, creating a bridge that increases coupling.

As such, FIG. 8 illustrates the arrangement where coupling tuning element 108 is employed to provide coupling between the two coaxial cavity resonators. Regions 110, 112 and 114 identify the locations within the structure where insulating members are employed in accordance with the arrangements described above. Regions 110, 112 and 114 include insulating supports for receiving corresponding tuning elements, or in accordance with other embodiments of the invention, regions 110, 112 and 114 include tuning elements with corresponding insulated sleeves.

Figure 9A:
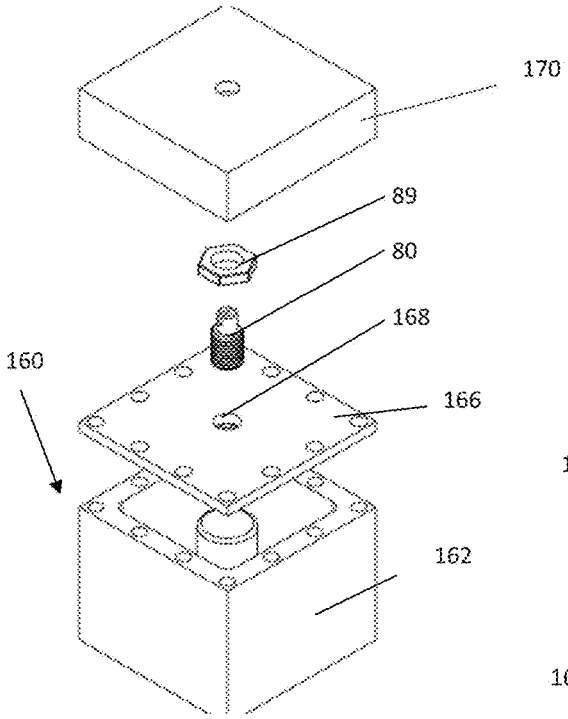
FIGS. 9*a*-9*d* illustrate a coaxial cavity resonator filter having a solid post in accordance with one embodiment of the invention.
Figure 9B:
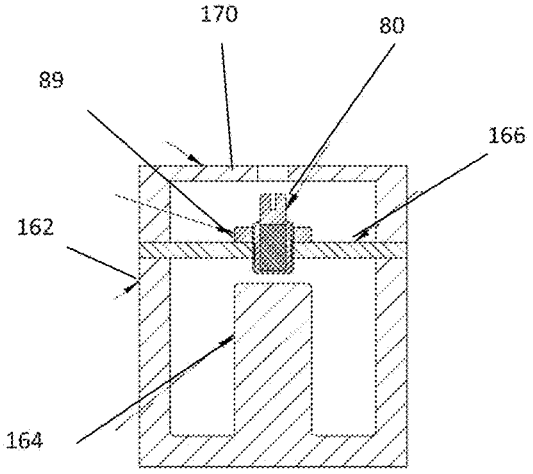
Figure 9C:
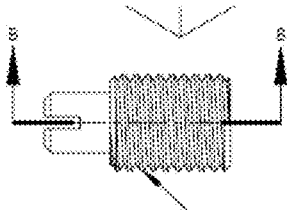
Figure 9D:
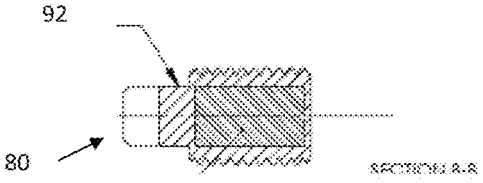

In accordance with other embodiments, the intermodulation distortion effect can be substantially reduced in a variety of cavity resonator structures. For example, FIGS. 9*a*-9*d* illustrate an embodiment in connection with a solid resonator within a resonant cavity. As such, FIG. 9*a* illustrates a filter 160 having a filter body 162 forming a cavity cube with five close sides and a top open side. A solid resonator 164 is disposed within the cavity. A cover 166 is placed over the open top of the cavity. Cover 166 includes an opening 168 for allowing tuning element 80 to engage within the cavity. A lock nut member 89 is screwed on the tuning element as illustrated in FIG. 9*a*. Thereafter a shield plate 170 is placed over the filter to isolate the filter from its adjacent environment. FIG. 9*b* is a side view of filter 160 illustrating the manner tuning element 80 engages the resonant cavity. In accordance with one embodiment of the invention, FIG. 9*c* illustrates tuning element 80 that is a made of a conductor covered by a threaded insulator having external threads as discussed before. FIG. 9*d* is a cross section of tuning element 80 showing the conductive element embedded within the insulator covering 92. During operation, tuning element 80 is adjusted by accessing the opening within shield 170.

FIGS. 10*a* and 10*b* illustrate another embodiment of filter 160. In this embodiment an insulator member such as a plug 180 is inserted within opening 160. Insulator member 180 has a double flange configuration, such that when inserted into the opening, the upper flange engages against the upper surface of cover 166 and the lower flange engages against the bottom surface of the cover. In accordance with one embodiment, the inside wall portion of the plug is threaded so as to allow tuning element 80 to move along the inside surface of the plug until the desired frequency response is achieved.

Figure 11A:
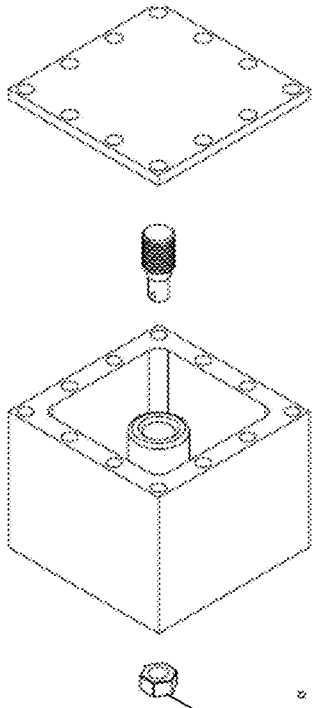
FIGS. 11*a*-11*d* illustrate one embodiment of the invention with a hollow post.
Figure 11B:
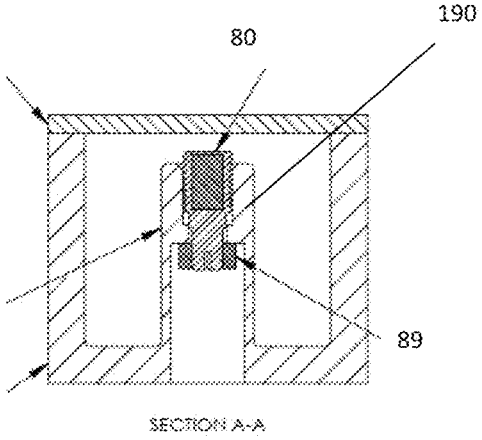
Figure 11C:
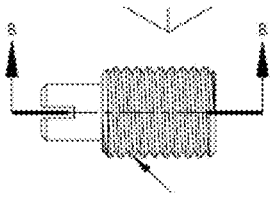
Figure 11D:
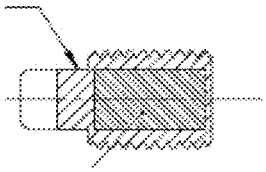

FIGS. 11*a* through 11*d* show another embodiment where the resonator post 190 is hollow, allowing the tuning element 80 to engage with the cavity resonator from its bottom side. FIGS. 11*c* and 11*d* illustrate a tuning element 80 having the same construction as the one depicted in FIGS. 9*c* and 9*d*.

Figure 12A:
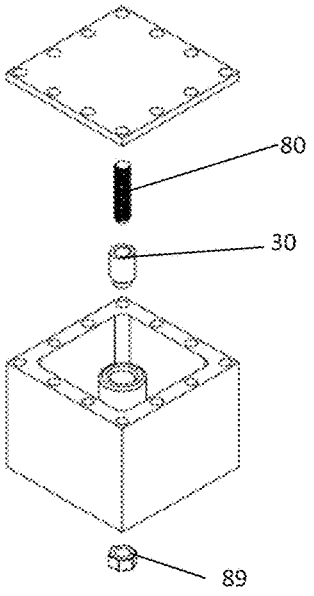
FIGS. 12*a* and 12*d* illustrate another embodiment of the invention with a hollow post.
Figure 12B:
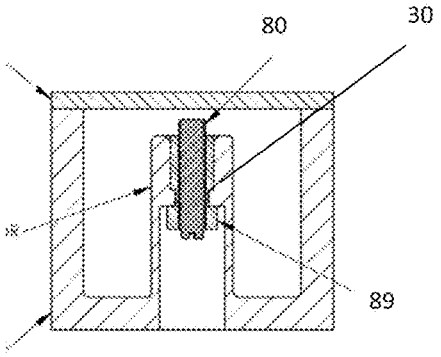

FIGS. 12*a* and 12*b* show yet another embodiment where the resonator post is also hollow, allowing the tuning element 80 to engage with the cavity resonator from the bottom side. As illustrated in FIG. 12*b*, insulating support member 30 is inserted within the resonator post, and screw 80 is inserted within the insulating support member. A cover 192 is disposed on the hollow cavity. Turning element 80 can be accessed and adjusted from the bottom side of the cavity filter.

Figure 13:
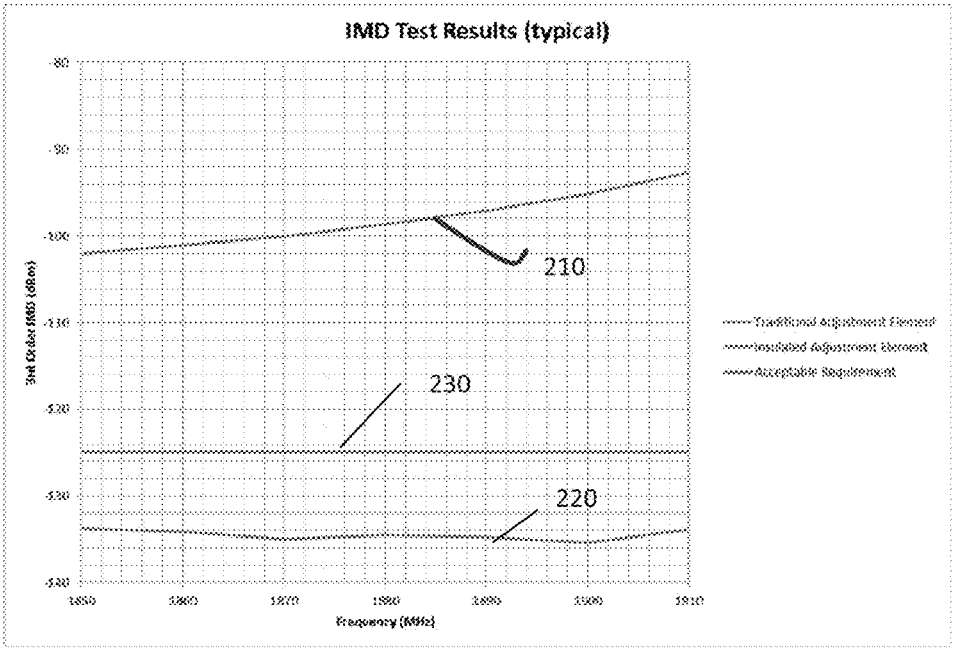
FIG. 13 illustrates the test results employing a coaxial cavity resonator in accordance with one embodiment.

The intermodulation distortion effect is substantially eliminated by using the various embodiments of the present invention as described above. For example, FIG. 13 illustrates the effects of intermodulation distortion, with and without the insulating support arrangement of the present invention. As illustrated, graph 210 represents the distortion level without the insulating support employed in accordance with the present invention, and line graph 220 represents the distortion level with the insulating support employed in accordance with the present invention. Line 230 illustrates an exemplary acceptable frequency response. While all points on graph 210 are above line 230, all points on graph 220 are within the acceptable limits.

As such, in accordance with various embodiments of the present invention, an arrangement for insulating the tuning element of a coaxial cavity resonator from the remaining portions of the structure provides a substantial reduction in intermodulation distortion.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A coaxial cavity resonator filter comprising:

a hollow cavity and a post having desired dimensions for achieving desired filter characteristics, a tuning element supported within a first opening of said post and configured to electromagnetically interact with said post, said tuning element having a conductive core element, wherein an orientation of said tuning element within said hollow cavity is adjusted so as to achieve said desired filter characteristics, said tuning element further having an insulator configured to embed and electrically insulate said conductive core element from said first opening of said post, wherein a portion of said insulator is threaded so as to allow said conductive core element to vary an orientation thereof within said cavity without contacting said first opening.

2. A coaxial cavity resonator filter in accordance with claim 1, wherein said post is a hollow post, and the orientation of said tuning element is adjusted within a space defined by said hollow post.

3. A coaxial cavity resonator filter in accordance with claim 2, wherein said hollow post includes a first opening and an inner wall, wherein a first portion of said inner wall has a diameter that is larger than a diameter of said tuning element, said hollow post further includes a flange that forms a second opening having a specified height and a diameter that is smaller than a diameter of said first opening;

wherein said insulator is formed by an insulating support member disposed within said hollow post, said insulating support member having a first head portion having a first diameter and a shoulder flange portion having a smaller diameter than said first diameter of said head portion, such that said shoulder flange portion is fitted within said second opening of the hollow post; and wherein said tuning element is received by said insulating support member, such that a length of said tuning element is varied within the hollow post so as to vary the desired frequency characteristics of the coaxial cavity resonator filter.

4. The coaxial cavity resonator filter in accordance with claim 3 wherein an inside diameter of said shoulder flange portion of said insulating support member is threaded.

5. The coaxial cavity resonator filter in accordance with claim 4, wherein an outside diameter of said tuning element includes a threaded portion that engages with the threaded portion of said inside diameter of said shoulder flange portion.

6. The coaxial cavity resonator filter in accordance with claim 5 wherein said hollow cavity has a cylindrical shape.

7. The coaxial cavity resonator filter in accordance with claim 4, further including a lock nut for fixing a position of said tuning element within said hollow cavity.

8. A coaxial cavity resonator filter in accordance with claim 2, wherein said hollow post further comprises:

a first opening and an inner wall, wherein a first portion of said inner wall has a diameter that is larger than a diameter of said tuning element, said hollow post further includes a flange that forms a second opening having a specified height and a diameter that is smaller than a diameter of said first opening, and a second portion of said inner wall having a diameter that is smaller than the diameter of said first portion;

wherein said insulator forms a threaded sleeve over the conductive core element of said tuning element, wherein said threaded sleeve engages with said second portion of said inner wall, such that a length of said tuning element is varied within the hollow post so as to vary the desired frequency characteristics of the coaxial cavity resonator filter.

9. The coaxial cavity resonator filter in accordance with claim 8, wherein the inside surface of said second portion of said hollow post is threaded so as to engage with said threaded portion of said insulator.

10. The coaxial cavity resonator filter in accordance with claim 9 wherein said hollow cavity has a cylindrical shape.

11. The coaxial cavity resonator filter in accordance with claim 9, further including a lock nut for fixing a position of said tuning element within said hollow cavity.

* * * * *